US007389664B1

(12) United States Patent
Cheng et al.

(10) Patent No.: US 7,389,664 B1
(45) Date of Patent: Jun. 24, 2008

(54) ELECTROMAGNETIC FORMING DEVICE FOR SHEET OF MATERIAL

(75) Inventors: Tung-Chen Cheng, Kaohsiung (TW); Tzyy-Ker Sue, Kaohsiung (TW); Chi-Keung Chung, Kaohsiung (TW); Chun-Chieh Wang, Kaohsiung (TW); Hsing-Ta Hsieh, Kaohsiung (TW); Ming-Fu Li, Kaohsiung (TW)

(73) Assignee: Metal Industries Research & Development Centre, Kaohsiung (TW)

( * ) Notice: Subject to any disclaimer, the term of this patent is extended or adjusted under 35 U.S.C. 154(b) by 0 days.

(21) Appl. No.: 11/939,737

(22) Filed: Nov. 14, 2007

(30) Foreign Application Priority Data

Sep. 10, 2007 (TW) ..... 96133705 A

(51) Int. Cl.
*B21D 26/02* (2006.01)

(52) U.S. Cl. ..... 72/56; 72/707

(58) Field of Classification Search ..... 72/56, 72/379.2, 430, 707; 335/285, 286, 289–295
See application file for complete search history.

(56) References Cited

U.S. PATENT DOCUMENTS 5,953,805 A 9/1999 Steingroever
6,047,582 A 4/2000 Daehn et al.
6,050,120 A 4/2000 Daehn et al.
6,128,935 A 10/2000 Daehn et al.
6,229,125 B1 5/2001 Livshiz et al.
6,591,649 B1 7/2003 Gafri et al.
6,708,542 B1 3/2004 Gafri et al.
6,751,994 B2 6/2004 Horton et al.
7,069,756 B2 7/2006 Daehn
7,076,981 B2 7/2006 Bradley et al.
7,165,429 B2 1/2007 Steingroever
2007/0084261 A1 4/2007 Golovashchenko

*Primary Examiner*—Ramon M Barrera
(74) *Attorney, Agent, or Firm*—Volentine & Whitt, PLLC

(57) ABSTRACT

An electromagnetic forming device for a sheet of material is provided. The electromagnetic forming device includes a fixing base, a magnetic concentration block, an electromagnetic actuator, and a die. The fixing base has a groove. The magnetic concentration block is disposed in the groove of the fixing base, and has an accommodating space therein, which is in communication with a surface of the magnetic concentration block via a slit. The electromagnetic actuator, used to generate a magnetic field, is disposed in the accommodating space of the magnetic concentration block, but does not contact the magnetic concentration block. The die and the magnetic concentration block are separated by a gap, and a sheet of material can be disposed in the gap. As the magnetic concentration block is a block, eddy currents in the magnetic concentration block are distributed uniformly, so the generated magnetic field is also distributed uniformly, thus exerting a uniform forming force on the sheet of material.

14 Claims, 4 Drawing Sheets

ELECTROMAGNETIC FORMING DEVICE FOR SHEET OF MATERIAL

BACKGROUND OF THE INVENTION

1. Field of the Invention

The present invention relates to an electromagnetic forming device for a sheet of material. More particularly, the present invention relates to an electromagnetic forming device for a sheet of material including a magnetic concentration block.

2. Description of the Related Art

FIG. 1 shows a schematic cross-sectional view of a conventional electromagnetic forming device for a sheet of material as disclosed in U.S. Pat. No. 7,069,756. The conventional electromagnetic forming device 1 includes a conductive frame 11, an electromagnetic actuator 12, and a die portion 13. The die portion 13 defines a profiled die surface 132. The electromagnetic actuator 12 is arranged opposite the profiled die surface 132 of the die portion 13, and comprises a plurality of turns of inductive coils (not shown). A sheet of material 14 is secured in a position between the electromagnetic actuator 12 and the profiled die surface 132.

The operation manner of the electromagnetic forming device 1 is as follows. First, a clamp device (not shown) is used to apply a clamping force 17 on the conductive frame 11 and the die portion 13, so as to clamp the sheet of material 14. Then, the electromagnetic actuator 12 are powered to generate an impulse current 15 therein. Meanwhile, the conductive frame 11 and the sheet of material 14 are induced to generate an eddy current 16. As the impulse current 15 and the eddy current 16 are in opposite directions, the magnetic fields generated are also in opposite directions, so a repulsive force is generated between the electromagnetic actuator 12 and the sheet of material 14. Therefore, the sheet of material 14 impacts the profiled die surface 132 of the die portion 13 at a high speed, and has a pattern corresponding to the profiled die surface 132.

The disadvantages of the electromagnetic forming device 1 are as follows. Among the plurality of turns of inductive coils, as a gap exists between neighboring coils, the magnetic field in the space close to the coils is not uniformly distributed. Therefore, when the electromagnetic forming device 1 is used to form workpieces with fine structural patterns, the fine structural patterns may become partially vague where the magnetic fields are weak. In addition, in order to process products with different shapes or patterns, different forms of electromagnetic actuator 12 must be used, so the processing cost will increase.

Therefore, it is necessary to provide an electromagnetic forming device for a sheet of material to solve the above problems.

SUMMARY OF THE INVENTION

The present invention is directed to an electromagnetic forming device for a sheet of material. The electromagnetic forming device includes a fixing base, a magnetic concentration block, an electromagnetic actuator, and a die. The fixing base has a groove. The magnetic concentration block is disposed in the groove of the fixing base, and has an accommodating space therein, which is in communication with a surface of the magnetic concentration block via a slit. The electromagnetic actuator, used to generate a magnetic field, is disposed in the accommodating space of the magnetic concentration block, but does not contact the magnetic concentration block. The die and the magnetic concentration block are separated by a gap, and a sheet of material is disposed in the gap. As the magnetic concentration block is a block, eddy currents in the magnetic concentration block are distributed uniformly, so the magnetic field generated is also distributed uniformly, thus exerting a uniform forming force on the sheet of material. Moreover, in order to process products with different shapes or patterns, only the magnetic concentration block, rather than the electromagnetic actuator, needs to be replaced, so the manufacturing cost can be reduced.

DETAILED DESCRIPTION OF THE INVENTION

Figure 1:
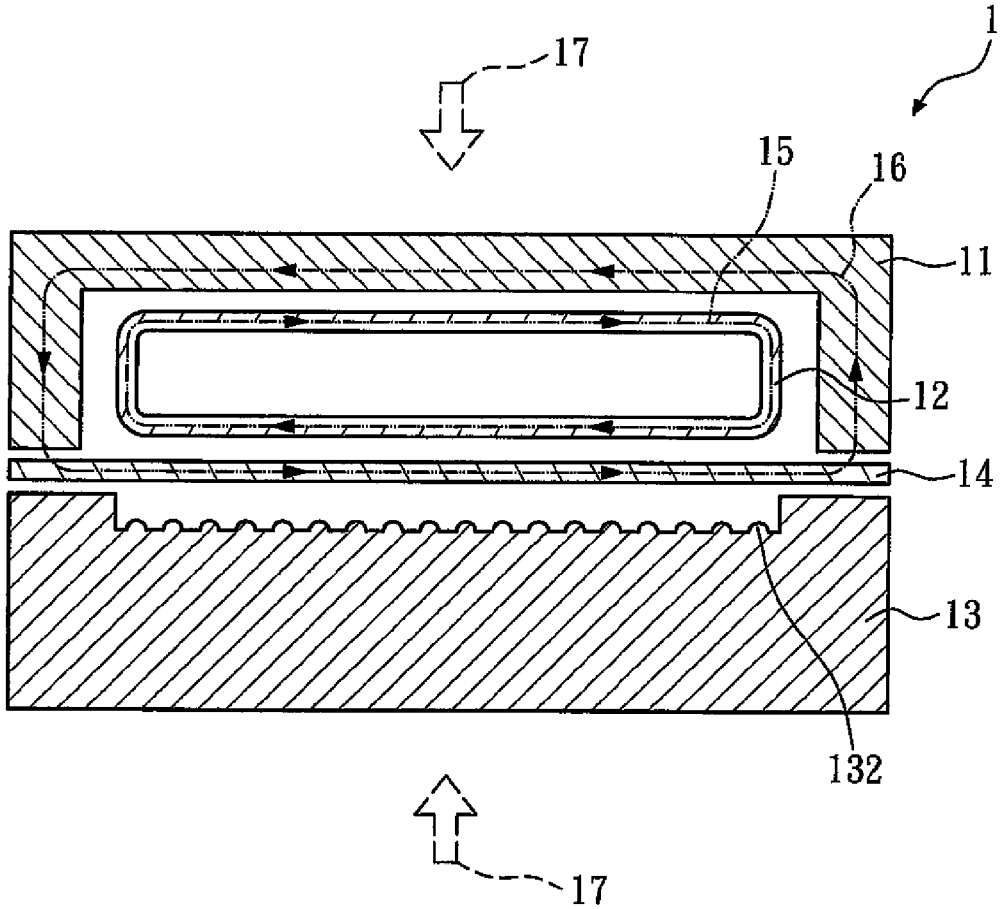
FIG. 1 (Prior Art)
FIG. 1 is a schematic cross-sectional view of a conventional electromagnetic forming device for a sheet of material as disclosed in U.S. Pat. No. 7,069,756.
Figure 2:
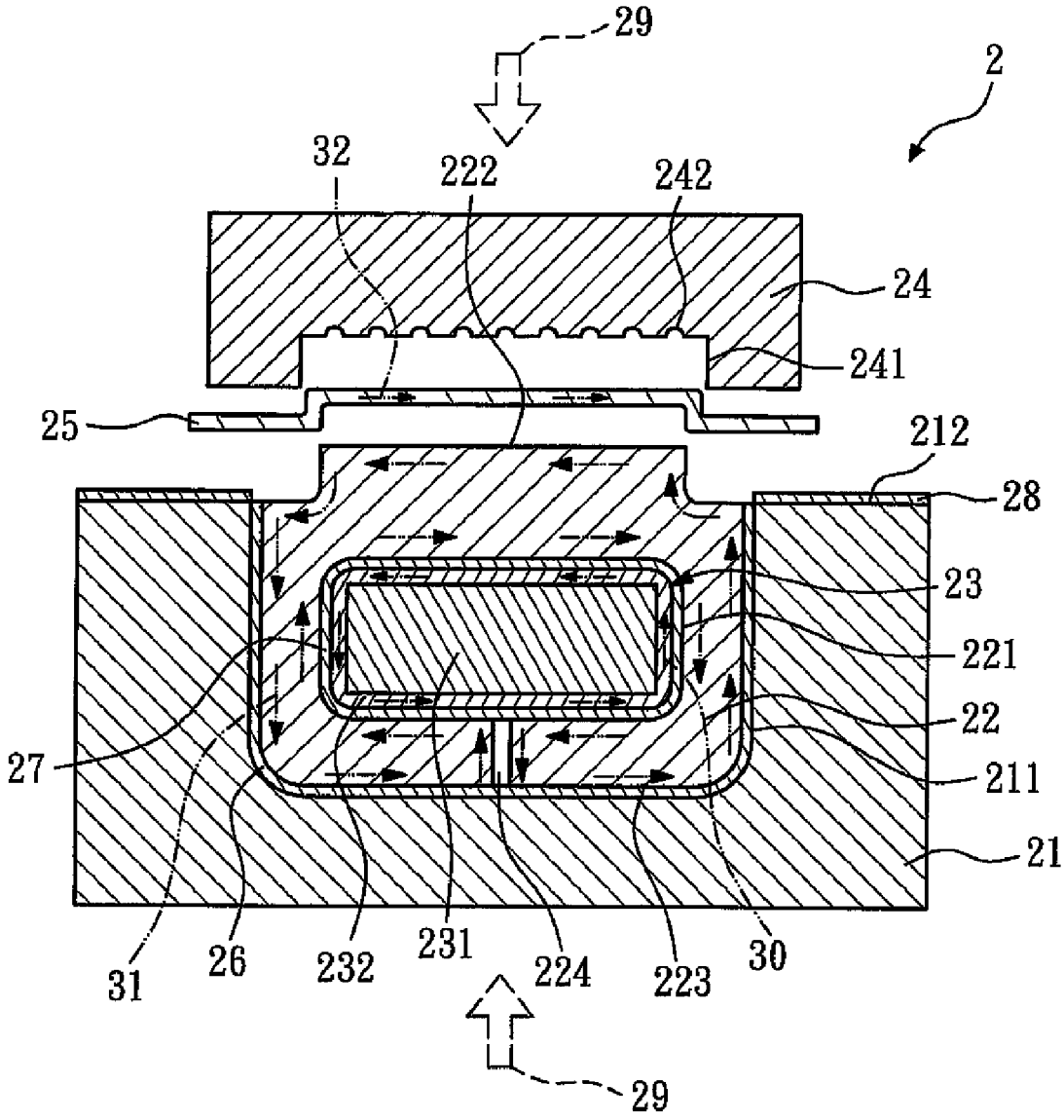
FIG. 2 is a schematic cross-sectional view of an electromagnetic forming device for a sheet of material according to a first embodiment of the present invention.

FIG. 2 shows a schematic cross-sectional view of an electromagnetic forming device for a sheet of material according to a first embodiment of the present invention. The electromagnetic forming device 2 includes a fixing base 21, a magnetic concentration block 22, an electromagnetic actuator 23, and a die 24. The fixing base 21 includes a groove 211 and a first surface 212. The groove 211 is open on the first surface 212. The magnetic concentration block 22 is disposed in the groove 211 of the fixing base 21, and has an accommodating space 221, a first surface 222, a second surface 223, and a slit 224. The accommodating space 221 is disposed inside the magnetic concentration block 22, and it is in communication with the second surface 223 of the magnetic concentration block 22 via the slit 224. Alternatively, the accommodating space 221 may be in communication with the first surface 222 of the magnetic concentration block 22 via the slit 224. The first surface 222 of the magnetic concentration block 22 is exposed on the first surface 212 of the fixing base 21. In order to deal with different processing shapes, the first surface 222 of the magnetic concentration block 22 can be a flat plane, a curved plane, or another 3D surface. In this embodiment, the first surface 222 of the magnetic concentration block 22 protrudes from the first surface 212 of the fixing base 21.

The electromagnetic actuator 23 is used to generate a magnetic field, and is disposed in the accommodating space 221 of the magnetic concentration block 22, but does not contact the magnetic concentration block 22. In this embodiment, the electromagnetic actuator 23 includes a body 231 and a plurality of turns of coils 232. The body 231 is made of an insulating material, and the coils 232 are wrapped around the body 231. The die 24 and the magnetic concentration block 22 are separated by a gap, and a sheet of material 25 can be placed in the gap. The sheet of material 25 can be an unprocessed sheet of material or a preformed sheet metal. In this embodiment, the sheet of material 25 is a preformed sheet metal. The die 24 has a die cavity 241, and the die cavity 241 has a pattern 242 on a surface thereof.

Preferably, the electromagnetic forming device 2 further includes a first insulating layer 26, a second insulating layer 27, and a third insulating layer 28. The first insulating layer 26 is disposed between the fixing base 21 and the magnetic concentration block 22. The second insulating layer 27 is disposed between the magnetic concentration block 22 and the electromagnetic actuator 23. The third insulating layer 28 is disposed on the first surface 212 of the fixing base 21.

The operation manner of the electromagnetic forming device 2 is as follows. First, a clamp device (not shown) is used to apply a clamping force 29 on the fixing base 21 and the die 24, so as to clamp the sheet of material 25. Then, the electromagnetic actuator 23 is powered to generate an impulse current 30 therein (e.g., within the coils 232). Meanwhile, the magnetic concentration block 22 is induced to generate a first eddy current 31. As the magnetic concentration block 22 has the slit 224, the first eddy current 31 flows from the inner wall to the outer wall of the magnetic concentration block 22. Then, the sheet of material 25 is induced to generate a second eddy current 32. As the first eddy current 31 and the second eddy current 32 are in opposite directions, the magnetic fields generated are also in opposite directions, so a repulsive force is generated between the magnetic concentration block 22 and the sheet of material 25. Therefore, the sheet of material 25 impacts the die cavity 241 of the die 24 at a high speed, and has a pattern corresponding to the pattern 242.

The advantages of the electromagnetic forming device 2 are as follows. As the magnetic concentration block 22 is a block, the first eddy current 31 in the magnetic concentration block 22 is distributed uniformly, and the magnetic field generated is also distributed uniformly, thus exerting a uniform forming force on the sheet of material 25. In addition, the magnetic concentration block 22 can be made into a 3D shape according to the shape of the preformed sheet of material. If products of different shapes or with patterns are to be processed, only the magnetic concentration block 22, rather than the electromagnetic actuator 23, needs to be replaced, and thus the processing cost is reduced.

Figure 3:
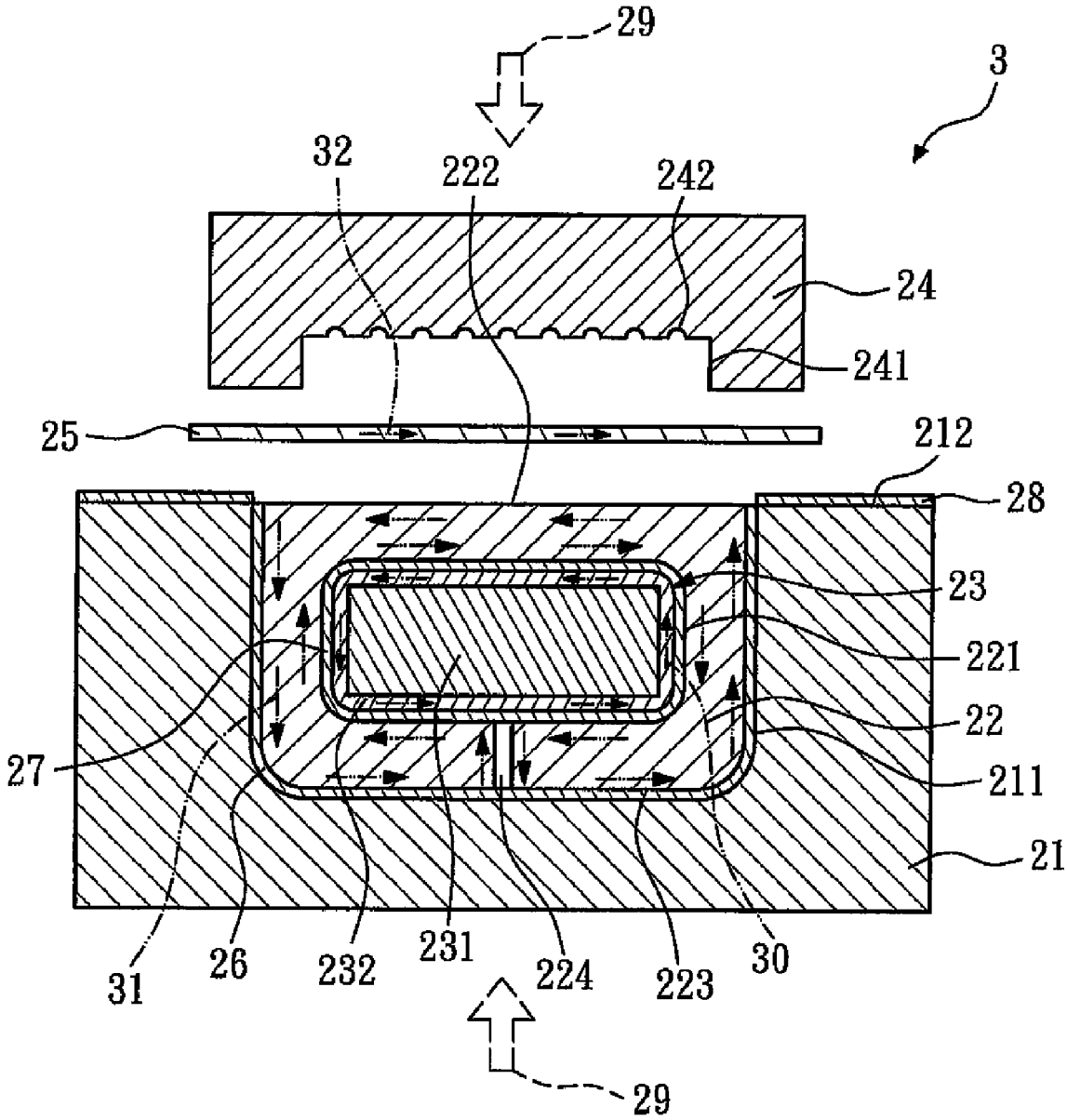
FIG. 3 is a schematic cross-sectional view of an electromagnetic forming device for a sheet of material according to a second embodiment of the present invention.

FIG. 3 shows a schematic cross-sectional view of an electromagnetic forming device for a sheet of material according to a second embodiment of the present invention. The electromagnetic forming device 3 of this embodiment is substantially the same as the electromagnetic forming device 2 of the first embodiment, and the same components in the two embodiments are marked with the same reference numerals. The difference between the electromagnetic forming device 3 of this embodiment and the electromagnetic forming device 2 of the first embodiment is that, the sheet of material 25 is an unprocessed sheet of material in this embodiment, and the first surface 222 of the magnetic concentration block 22 is located at the same level as the first surface 212 of the fixing base 21.

Figure 4:
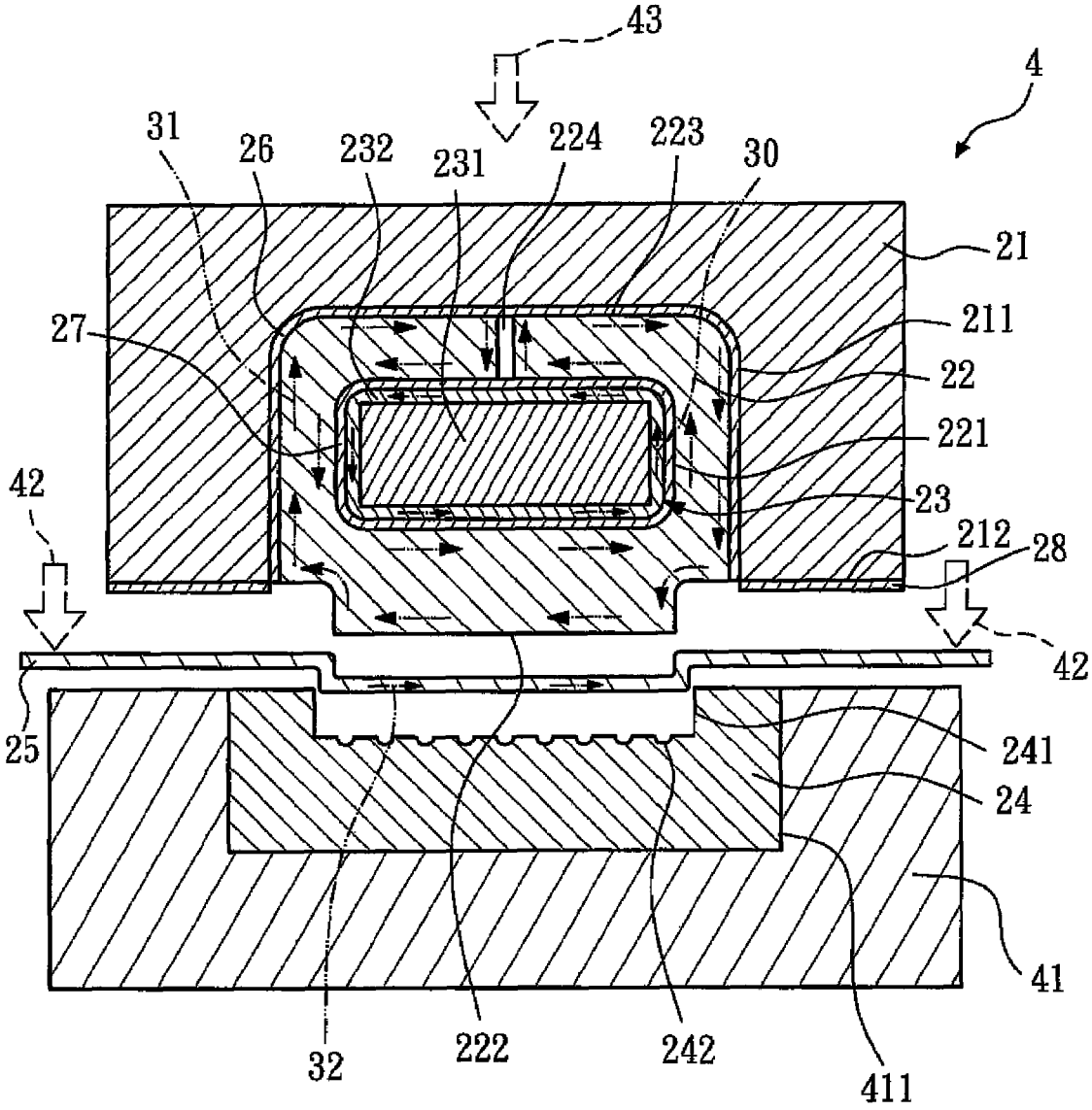
FIG. 4 is a schematic cross-sectional view of an electromagnetic forming device for a sheet of material according to a third embodiment of the present invention.

FIG. 4 shows a schematic cross-sectional view of an electromagnetic forming device for a sheet of material according to a third embodiment of the present invention. The electromagnetic forming device 4 of this embodiment is substantially the same as the electromagnetic forming device 2 of the first embodiment in which the same components in the two embodiments are marked with the same reference numerals. The difference between the electromagnetic forming device 4 of this embodiment and the electromagnetic forming device 2 of the first embodiment is that the two devices are in opposite directions, and the electromagnetic forming device 4 further includes a platform 41. The platform 41 has an accommodating cavity 411 to accommodate the die 24.

The operation manner of the electromagnetic forming device 4 is as follows. First, a pressing device (not shown) is used to apply a pressing force 42 on the sheet of material 25, so as to press the sheet of material 25 on the platform 41. Next, a support device (not shown) is used to apply a supporting force 43 on the fixing base 21, so that the fixing base 21 moves downwards, but does not contact the sheet of material 25. Then, the electromagnetic actuator 23 is powered to generate an impulse current 30 therein. The subsequent steps are the same as those of the electromagnetic forming device 2 in the first embodiment. The structure of such electromagnetic forming device 4 can be combined with conventional punching or hydraulic processing procedures.

While several embodiments of the present invention have been illustrated and described, various modifications and improvements can be made by those skilled in the art. The embodiments of the present invention are therefore described in an illustrative but not restrictive sense. It is intended that the present invention should not be limited to the particular forms illustrated, and that all modifications which maintain the spirit and scope of the present invention are within the scope defined in the appended claims.

What is claimed is:

1. An electromagnetic forming device for a sheet of material, comprising:

a fixing base, having a groove;

a magnetic concentration block, disposed in the groove of the fixing base, and having an accommodating space therein, wherein the accommodating space is in communication with a surface of the magnetic concentration block via a slit;

an electromagnetic actuator, for generating a magnetic field, wherein the electromagnetic actuator is disposed in the accommodating space of the magnetic concentration block, but does not contact the magnetic concentration block; and a die, separated from the magnetic concentration block by a gap, and a sheet of material can be disposed in the gap.

2. The electromagnetic forming device as claimed in claim 1, wherein the fixing base has a first surface, the groove is open on the first surface, the magnetic concentration block has a first surface and a second surface, and the first surface of the magnetic concentration block is exposed on the first surface of the fixing base.

3. The electromagnetic forming device as claimed in claim 2, wherein the first surface of the magnetic concentration block protrudes from the first surface of the fixing base.

4. The electromagnetic forming device as claimed in claim 2, wherein the first surface of the magnetic concentration block is a flat plane.

5. The electromagnetic forming device as claimed in claim 2, wherein the first surface of the magnetic concentration block is a curved plane.

6. The electromagnetic forming device as claimed in claim 2, wherein the slit is open on the second surface of the magnetic concentration block.

7. The electromagnetic forming device as claimed in claim 1, further comprising an insulating layer disposed between the fixing base and the magnetic concentration block.

8. The electromagnetic forming device as claimed in claim 1, further comprising an insulating layer disposed between the magnetic concentration block and the electromagnetic actuator.

9. The electromagnetic forming device as claimed in claim 1, further comprising an insulating layer disposed on a surface of the fixing base.

10. The electromagnetic forming device as claimed in claim 1, wherein the electromagnetic actuator comprises a body and a plurality of turns of coils, the body is made of an insulating material, and the coils are wrapped around the body.

11. The electromagnetic forming device as claimed in claim 1, wherein the die has a die cavity, and the die cavity has a pattern on a surface thereof.

12. The electromagnetic forming device as claimed in claim 1, further comprising a platform, wherein the platform has an accommodating groove to accommodate the die.

13. The electromagnetic forming device as claimed in claim 1, wherein the sheet of material is an unprocessed sheet of material or a preformed sheet of material.

14. The electromagnetic forming device as claimed in claim 1, wherein the sheet of material is a sheet metal.

* * * * *